United States Patent [19]

Tomma

[11] Patent Number: 4,691,488

[45] Date of Patent: Sep. 8, 1987

[54] METHOD FOR PRODUCING A CONCRETE-FILLED STEEL BODY FOR SUPPRESSING VIBRATIONS

[75] Inventor: Kauko Tomma, Helsinki, Finland

[73] Assignee: Oy Wartsila AB, Helsinki, Finland

[21] Appl. No.: 666,967

[22] Filed: Oct. 31, 1984

Related U.S. Application Data

[63] Continuation-in-part of Ser. No. 291,928, Aug. 11, 1981, abandoned, which is a continuation of Ser. No. 33,219, Apr. 25, 1979, abandoned, which is a continuation of Ser. No. 648,744, Jan. 12, 1976, abandoned, which is a continuation of Ser. No. 514,320, Oct. 11, 1974, abandoned.

[51] Int. Cl.[4] ..... E04C 3/10; B65H 16/02; B65H 18/00; B28B 9/04

[52] U.S. Cl. ..... 52/223 R; 52/224; 242/67.2; 248/559; 264/228

[58] Field of Search ..... 52/291, 928, 223 R, 52/223 L, 224; 264/228, 256, 333; 408/143, 234; 248/559, 679; 242/55, 67.2

[56] References Cited

U.S. PATENT DOCUMENTS

| | | | |
|---|---|---|---|
| 2,370,384 | 2/1945 | Williamson | 74/841 |
| 2,398,239 | 4/1946 | Melin | 248/679 X |
| 2,660,049 | 11/1953 | Maney | 52/224 |
| 2,903,877 | 9/1959 | Meade | 52/224 X |
| 2,971,295 | 2/1961 | Reynolds | 52/228 |
| 3,202,740 | 8/1965 | Patin | 264/228 |
| 3,260,020 | 7/1966 | Patin | 52/224 |
| 3,431,691 | 3/1969 | Greaves et al. | 52/223 R |
| 3,695,532 | 10/1972 | Lindstaedt | 242/55 |
| 3,800,634 | 4/1974 | Zagar | 408/234 X |
| 3,858,374 | 1/1975 | Ben-Zvi | 52/223 R |

FOREIGN PATENT DOCUMENTS

| | | | |
|---|---|---|---|
| 522510 | 4/1931 | Fed. Rep. of Germany | 52/223 R |
| 1056348 | 4/1959 | Fed. Rep. of Germany | 52/223 R |
| 1188509 | 3/1959 | France | 52/2 F |

*Primary Examiner*—Alfred C. Perham
*Attorney, Agent, or Firm*—Martin Smolowitz

[57] ABSTRACT

A method for producing a constructional element comprising a steel casing filled with concrete, for instance, a machine body having good load carrying and vibration-absorbing properties. The main steel parts of the element are arranged to form a hollow casing filled with a fluid concrete mass. Internal pressure is supplied in the casing to act on the concrete mass during its hardening phase, the pressure being selected so as to provide in the steel casing an elastic deformation and expansion which substantially exceeds the shrinkage of the concrete mass during its hardening phase. The internal pressure must be sufficient to cause such a deformation of the steel casing that there is a remaining compression between the steel casing against the dry shrunk concrete in the finished element under all the loading and deforming conditions for which the constructional element has been designed. Special concrete mixes and casing filling procedures are used, which produce a concrete and steel construction element having good vibration-absorbing properties.

10 Claims, 4 Drawing Figures

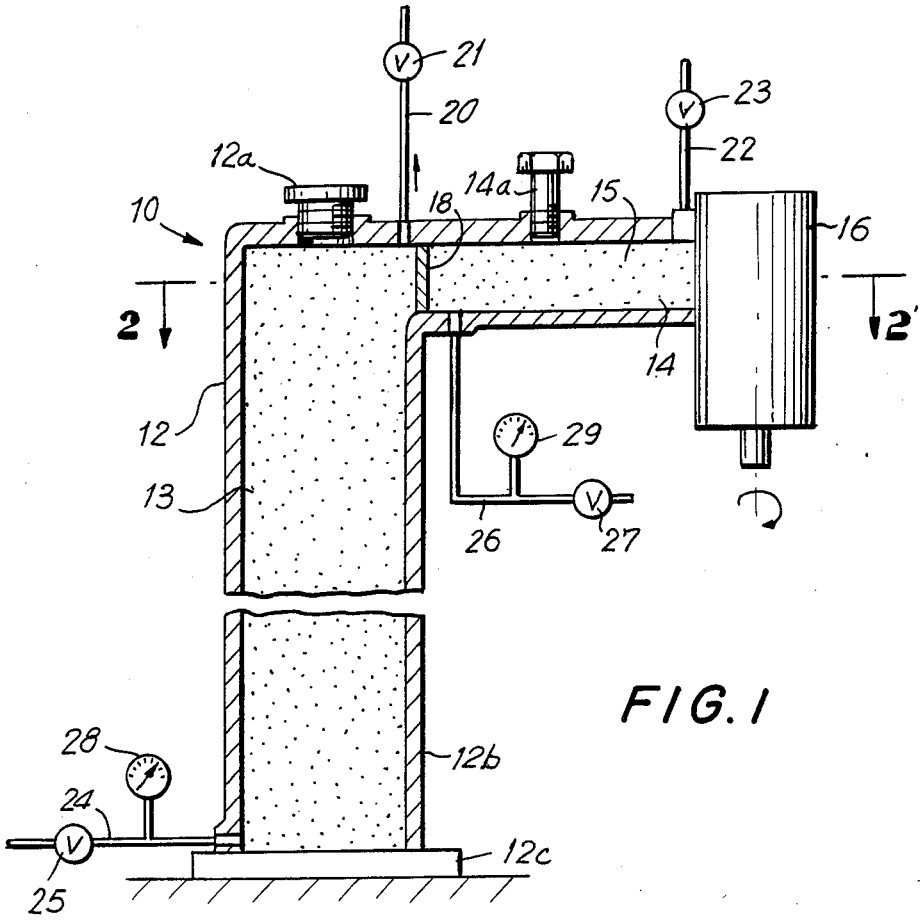
FIG. 1
FIG. 2
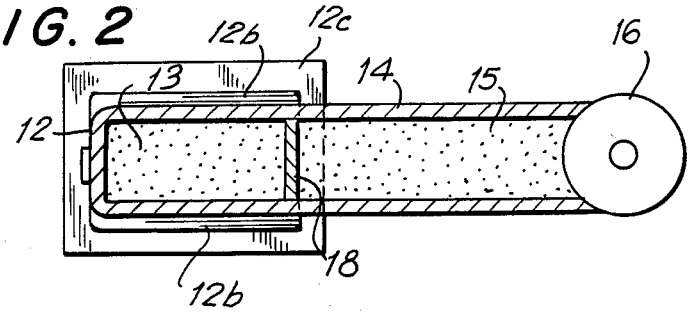

METHOD FOR PRODUCING A CONCRETE-FILLED STEEL BODY FOR SUPPRESSING VIBRATIONS

BACKGROUND OF INVENTION

This is a continuation-in-part application of Ser. No. 291,928 filed Aug. 11, 1981 now abandoned, which in turn is a continuation of Ser. Nos. 033,219, filed Apr. 25, 1979; 648,744, filed Jan. 12, 1976; and 514,320, filed Oct. 11, 1974 (all abandoned).

The invention relates to a method for producing a concrete filled box-like steel machine body or a part thereof, so as to provide a combination concrete-steel stressed structure having good load carrying and vibration absorbing properties.

One of the objects or purposes of a machine body is to provide as stable a support as possible for other parts, usually moving machine parts. When the machine works, periodically varying forces are often transmitted to the machine body. The frequency and the size of the force or load variations often cause vibrations in the machine body, which have a harmful effect on the operation of the machine. Due to this load variation and vibration, for instance, in cutting machines, the work of the cutters and the quality of the cut may become inferior. Therefore, a machine body is required to be rigid as well as to be able to absorb vibrations effectively.

The most commonly used materials in producing machine bodies are steel, cast iron and concrete. When judging the suitability of the material, its strength, modulus of elasticity and ability to absorb vibration are considered. High strength and a high modulus of elasticity are characteristic of steel, but its ability to absorb vibrations is the poorest of all the materials in question. Medium strength and elasticity properties are achieved by using cast iron and the absorption of vibrations is fair, even if it is to some extent dependent on the strength properties.

The use of concrete in a machine body has been the object of several experiments and much research and very positive results have been achieved, for instance, in frames for machine tools. The characteristic features of concrete are its low tensile strength and low modulus of elasticity, while its compressive strength is moderate and its ability to absorb vibrations is excellent.

The handling technique for concrete sets additional limitations compared with the use of metals in producing composite machine constructions. The concrete is used as a reinforcement material and for increasing the mass and stability of the structure. The concrete is usually reinforced with steel bars and is cast into an open steel or cast iron frame, so that the concrete does not cause any stress in the frame. Sometimes the concrete is reinforced by means of suitable fibers. This known method somewhat improves the vibration absorbing qualities of the frame, but it is far from what can be obtained by using the present invention. It has also proved to be difficult to completely fill a narrow box-like machine frame with concrete. A concrete-filled machine frame of the conventional type is in most cases unstable in prolonged use.

SUMMARY OF INVENTION

The object of the present invention is to eliminate the above-mentioned disadvantages of using steel and concrete for a construction element or machine body by combining these materials in a new way into one composite structural unit, and thus create an improved construction element or machine body which absorbs vibrations especially well but also has reasonably good elasticity and strength properties.

The present invention is characterized in that after filling a structural element or preferably box-like steel casing for a machine body with a fluid concrete mass, the concrete during its hardening phase is maintained under an internal pressure for a sufficient time, the pressure being so selected that it produces in the steel casing a stress not exceeding its elastic yield limit and thereby provides an elastic expansion substantially exceeding the shrinkage of the concrete mass during its hardening phase of such a degree that a residual compression force is maintained between the steel casing and the dry shrunk concrete, in the finished machine body even under all loading and deformation conditions of the construction element. Thus, during hardening of the concrete mass the steel casing of the machine body is subject to an elastic stress and expansion from an inside pressure exceeding the sum of the shrinkage of the concrete mass during its hardening phase and the deformation occurring due to any normal calculated load on the machine body, so that under operating conditions the casing is always pressed against the hardened concrete it is filled with, and thus, in addition to the good elasticity and strength properties of the steel casing, the machine body is effectively provided with the excellent vibration absorbing ability of concrete. Simultaneously, flat sides of the machine body are internally supported by the hardened concrete to withstand buckling and vibrations caused by external forces loading the composite machine body structure.

The filling of the body or casing is performed using concrete pouring or pumping methods, including the provision of openings for filling and air venting outlets. After the filling with concrete, or already during it, the pressure inside the closed steel casing is raised to a predetermined value using for instance, hydrostatic pressure produced by gravity, or by connecting the wet concrete to a water pressure system. Pressure is maintained on the concrete during its hardening phase until the strength of the hardening concrete is sufficient to maintain the expansion of the surrounding steel casing. An influence on the shrinking of the concrete during the drying and hardening phase can be provided for in advance by varying the filler material, the raw materials and their mixing ratios.

The proper inside pressure to be maintained on the concrete during its hardening phase is determined separately for each machine body construction, so that the maximum pressure used depends on the strength and form of every separate constructional part of the machine body. The stresses induced in the steel casing must not exceed the elastic yield limit or yield stress of the steel in question, in order to provide that there is always an elastic contraction of the steel casing during the hardening and shrinking phase of the concrete. The term elastic yield limit denotes the maximum stress at which the steel casing would exhibit elastic characteristics without any measurable or permanent set occurring in the stressed steel. The minimum of the pressure supplied is determined by the shrinkage properties of the concrete filling materials used, which can be regulated as stated above. However, in the finished machine body, there has to be at the contact surface between steel and concrete, such a compression pressure that no load deformation of the steel caused by external load eliminates even locally the contact pressure between the steel and the concrete, which, for its part, restrains and suppresses vibrations in the steel. Portions of the constructional element requiring substantially different internal pressure maintained during hardening of the concrete are separated from each other by internal walls resisting the actual pressure differences.

This method of the invention can be advantageously used for producing a load-carrying vibration-absorbing composite structures or machine bodies, including but not limited to machine tools having rotating elements, e.g. drills and milling machines, and for paper processing machinery, e.g. roll winders, calandering machines, web cutters, and the like.

BRIEF DESCRIPTION OF DRAWINGS

The invention will be further described by reference to the following drawings, in which:

FIG. 1 shows an elevation view of a typical hollow steel casing element filled and prestressed with concrete pressurized during its hardening phase;

FIG. 2 shows a cross-sectional view taken at lines 2—2' of FIG. 1 and also shows a base plate;

DESCRIPTION OF INVENTION

Figure 3:
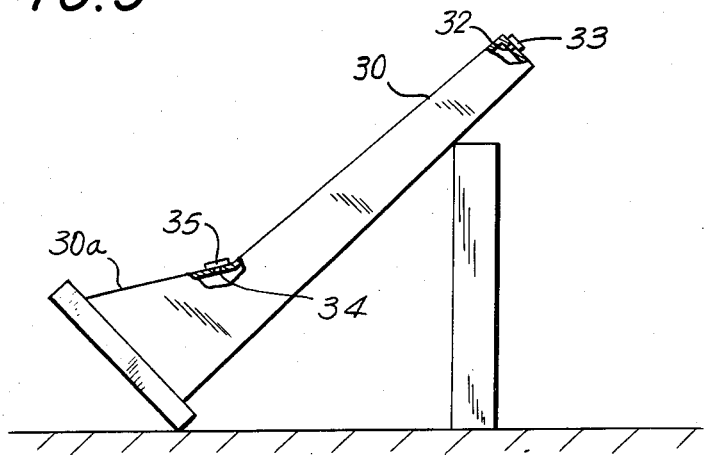
FIG. 3 shows a hollow steel casing element positioned for advantageous filling with stone aggregate.

One useful embodiment of the invention is illustrated by the FIG. 1 drawing, which generally shows a concrete-filled machine body 10 comprising a main box-shaped body portion 12 having an adjoining integral portion 14 and being designed as a vibration absorbing composite structure, for withstanding vibrations caused by rotary element within unit 16, which may be, for example, a rotary drill or milling unit. Due to the different cross-sectional dimensions needed for the body portions 12 and 14, different internal pressures are used in the casing portions for prestressing the casing walls during hardening of the concrete, in order to ensure a firm contact between the prestressed metal casing and the hardened concrete bodies 13 and 15 contained therein. Element 18 is an intermediate pressure-tight wall provided between the body portions 12 and 14 in order to permit use of different internal pressures imposed on the concrete bodies 13 and 15 therein during hardening of the concrete.

As shown in FIG. 1, the casing portions 12 and 14 are each provided with closable openings 12*a* and 14*a* at their upper ends for filling the casing with fluid concrete by gravity filling means. A vent connection 20 and 22 is also provided at the upper end of each casing portion 12 and 14 for venting air therefrom during filling, each vent being provided with shutoff valve 21 and valve 23, respectively. The concrete-filling machine body 10 and location of unit 16 containing rotary elements and partition element 18 is additionally shown in horizontal cross-section by FIG. 2, which also shows base portions 12*b* and base plate 12*c*. Casing portion 12 tapers outwardly to a wider dimension near the lower end 12*b*, and is rigidly affixed to base plate 12*c*.

In the method of the invention, a fluid concrete mass mixed to desired proportions usually including coarse stone aggregate, sand and Portland cement, is fed into each steel casing portion 12 and 14 at inlet connection 12*a* and 14*a* either by gravity, or by a suitable pump which maintains the steel casing interior under the desired pressure during the setting and hardening phase of the concrete masses 13 and 15. If the concrete is gravity filled into the steel casing sections, a residual volume of concrete is preferably provided in an attached stand pipe located above each casing portion, so as to provide a hydrostatic head to ensure that each casing is entirely filled with the pressurized fluid concrete before the hardening phase commences. Air is vented during such filling from the uppermost point in each casing portion at connection 20 and 22, which are usually equipped with shutoff valves 21 and 23. An external pressure source can be connected to the feed connections 12*a* and 14*a*, or preferably is connected at some other convenient location, to provide and maintain the desired internal pressure in each casing portion for properly prestressing the casing during the hardening phase of the concrete. The fluid concrete is preferably pumped into each casing portion 12 and 14 at the lower end thereof through connections 24 and 26, each connection provided with shut-off valves 25 and 27, respectively. The internal pressure in each casing portion is indicated by pressure gauges 28 and 29, respectively.

As an alternative method of the invention, the steel casing may be first filled with coarse stone aggregate and then with a fluid concrete mass. This concrete mass contains sand, Portland cement, water and an intrusion aid material. The diameter of the coarse stones of the aggregate is suitably 50–60 millimeters. If smaller stones are used, such as having a diameter of about 15 to 30 millimeters, the sand usually having a particle size of 2–5 mm can be left out of the mixture. A suitable intrusion aid material is produced by Prepact Iberica S.A. in Spain, and is available in the United States from Intrusion Prepact, Inc., in Cleveland, Ohio. Only a small amount of intrusion aid powder is used, usually between about 0.5–2.0 wt. percent of the cement used. The purpose for using an intrusion aid material is to reduce or eliminate the shrinkage of the concrete during its hardening phase and also to improve the fluidity and penetration of the concrete mass, so that it completely fills all free space within a casing prefilled with the stone aggregate.

To provide adequate residual compression loading on the concrete in the casing, each casing portion is pressurized to a pressure of 2–10 atmospheres to produce a stress of at least about 30% of and not exceeding the elastic yield limit of the steel casing material used. This internal pressure is maintained on the fluid concrete until it has substantially hardened, usually for 10–15 hours. Then the concrete filled machine body is left to rest motionless for about a week to make sure that the concrete is fully hardened and can withstand all deformation caused by external forces on the casing.

Because of the high compressive stress provided in the concrete during its hardening and shrinkage phase, a residual tensile stress remains in the steel casing against the hardened concrete during all normal conditions of loading on the machine body to provide good strength and vibration absorption characteristics for the machine body.

The alternative method or procedure for filling the hollow steel casing first with coarse sized stone is generally shown by FIG. 3, in which hollow steel casing 30 is supported stably at an angle with the vertical such as 45°–60° by a support 31. Casing 30 has provided at its upper end an opening 32, through which the coarse size pebbles or stones, i.e., having diameter of 50–60 mm, are poured into the casing. When the casing is substantially filled, the opening 32 is closed by cover plate 33 being welded pressure-tightly in place. Also, if the casing 30 has an enlarged portion 30*a* which is difficult to completely fill through opening 32 due to the angle of repose of the pebbles therein, a separate opening 34 can be provided for separate filling. After portion 30*a* is filled, the opening 34 is similarly closed by welding plate 35.

Figure 4:
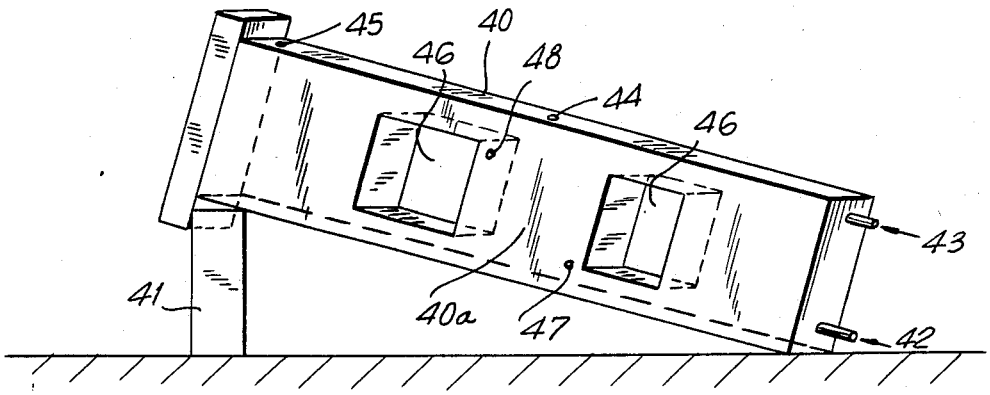
FIG. 4 shows a hollow steel casing element arranged for effective filling with fluid concrete material.

FIG. 4 shows an alternative method for completely filling hollow casing 40 by pumping the fluid concrete into it. After first being filled with coarse pebbles similarly as described for FIG. 3 above, the casing 40 is supported on one side by a suitable support 41 and the fluid concrete is injected under pressure through multiple openings 42 and 43. During such injection filling, the air is vented out through multiple top vent openings 44 and 45. After the fluid concrete commences flowing out these vent openings, they are closed pressure tightly such as by threaded plugs.

If the casing 40 is shaped so as to provide one or more void spaces 46 therein so as to provide a relatively isolated casing portion 40*a*, a separate filling connection 47 and vent connection 48 are provided to ensure that casing portion 40*a* is completely filled with fluid concrete and is pressurized during its hardening phase.

The invention will be further described by reference to the following examples, which should not be construed as limiting in scope.

EXAMPLE 1

An illustrating example of the vibration absorption ability of a machine body produced according to the invention is provided by an experimental test, in which the damping of natural frequencies of three machine body elements were compared. The machine elements each had a rectangular cross-section of 400×250 mm, the same wall thickness (15 mm) and were 2 m long, all three elements having the same dimensions. The materials tested were: Steel plate (St 37), case iron ANSI/ASTM A48 Class 35, and a steel casing filled with concrete in accordance with the invention, the steel casing being identical to the one used in the first test element. The concrete included as filler material about 70% granite chips, the cement was Portland cement, grain size of the same 3 mm, filling pressure 3.5 atmospheres or bar overpressure, hardening time before the experiment was 3 weeks (21 days). Tests made on these three machine body elements showed that the relative damping times for the natural vibration frequencies for the machine body elements were as follows:

| | |
|---|---|
| hollow steel element | 100 sec. |
| cast iron element | 5 sec. |
| steel element filled with concrete | 1 sec. |

Based on these results, it is noted that the steel casing filled with concrete exhibited a significantly lower damping time and superior vibration damping characteristics compared to steel or cast iron used alone for a similar shaped structure.

EXAMPLE 2

Various concrete ingredient mixes were investigated for use in a composite concrete-filled stressed steel casing in accordance with the invention. The following two mixes were found most suitable; all amounts are given in weight %.

| MIX | A | B |
|---|---|---|
| Stone aggregate, w % | 54 | 70 |
| Sand, w % | 18 | 0 |
| Cement, w % | 18 | 20 |
| Intrusion aid, w % | 1 | 1 |
| Water | 9 | 9 |

The diameters of the stones for the stone aggregate were as follows:

Mix A: 50–60 millimeters

Mix B: 15–30 millimeters

The stone aggregate means was washed, well screened, mainly spherical shaped stones.

In both cases the box-like steel casing was first filled with the coarse stone aggregate. Then the concrete mass including Portland cement, intrusion aid and water with or without sand was injected through an inlet opening of the casing (corresponding to the openings 24 and 26 of FIG. 1) by a suitable pump. The shrinkage of the concrete mass during its hardening phase was substantially prevented by the intrusion aid material. The intrusion aid also decreases the viscosity of the concrete mass and makes it possible to pump the concrete mass through the small spaces between the stones. The pumping usually required a pressure of 3 atmospheres, and this pressure is maintained during the hardening of concrete for at least 10 to 15 hours.

The invention was not limited to the application examples described, but several variations are feasible within the scope of the following claims.

What I claim is:

1. A method for damping vibrations in a machine body having moving parts, said machine body including a hollow box-like steel casing filled with a hardened concrete mass under compression from the casing, said machine body being produced by a method comprising:

filling said steel casing completely with a fluid concrete mass;

maintaining an internal pressure on said concrete mass from an external source during hardening thereof, said internal pressure being sufficient to cause an elastic deformation of said steel casing such that a vibration damping compression force remains from the steel casing against the concrete mass after its hardening under all load and deformation conditions imposed on the machine body;

whereby when a vibration type loading is applied to the machine body the loading is transferred from the steel casing to the hardened concrete mass, thereby providing good load carrying and vibration absorbing properties for the concrete-filled steel casing composite structure.

2. A method according to claim 1, including determining said internal pressure to suit individually separate portions of said constructional element so that the stress induced in said steel casing parts does not exceed the elastic yield limit of the steel for each part, the portions of said constructional element requiring substantially different pressures being separated from each other by internal walls resisting the actual pressure difference.

3. A method according to claim 1, including maintaining said fluid concrete mass under pressure also during the time it is being supplied into said hollow casing.

4. A method according to claim 1, including the step of using a pressurized water system as said external pressure source.

5. A method according to claim 1, including the step of first filling the casing with a coarse stone aggregate material, then injecting a fluid concrete mix into the casing lower portion, venting all air from the casing uppermost portion, and pressurizing the casing to provide said internal pressure.

6. A method according to claim 1, wherein said concrete mass includes an intrusion aid material comprising 0.5–2 w% of the concrete mix.

7. A method according to claim 1, wherein the fluid concrete mass is composed of about 50–75% stone chips, 0–20% sand having a nominal grain size of about 2–5 mm, Portland cement and water, the concrete having a hardening time of about two weeks.

8. A constructional element comprising a concrete-filled steel frame including a rotary unit for a machine having rotating paper web forwarding means, said element having good load carrying and vibration absorbing properties, comprising:

a combination of steel and concrete combined as load carrying materials, the main steel parts of said element forming a pressurizable hollow box-like steel casing, said casing being initially filled with a fluid concrete mass; supplying an internal pressure from an external source on said concrete mass during its hardening phase, said pressure being at least about 30% of but not exceeding the elastic limit of the casing, so as to positively expand said steel casing and provide therein an elastic expansion exceeding the sum of the shrinkage of said concrete mass during its hardening phase and any deformation occurring due to any normal load from said machine, said casing forming the main prestressing element of said constructional element, said casing being elastically expanded by the concrete for maintaining a firm contact between said casing and said concrete when substantial external loads are applied to said element, said concrete supporting said steel casing and damping vibrations induced in said steel casing.

9. A constructional element according to claim 8, including internal walls within said casing, whereby portions of the constructional element requiring substantially different pressures are separated from each other by the internal walls resisting the actual pressure differences between the casing portions.

10. A constructional element according to claim 8, wherein said concrete mass comprises 50–75 w % stone aggregate material, 0–20 w% sand, 15–25 w% Portland cement, 0.5–20 w% intrusion aid material, and originally about 8–10% water, and has a hardening time of at least 5 days.

* * * * *